United States Patent [19]

Booth et al.

[11] Patent Number: 4,537,816

[45] Date of Patent: Aug. 27, 1985

[54] PAPERMAKERS SUPERIMPOSED FELT WITH VOIDS FORMED BY REMOVING YARNS

[75] Inventors: Ian K. Booth, Clinton; Francis J. Cunnane, III, Laurens, both of S.C.

[73] Assignee: Ascoe Felts, Inc., Clinton, S.C.

[21] Appl. No.: 659,277

[22] Filed: Oct. 10, 1984

Related U.S. Application Data

[63] Continuation of Ser. No. 484,575, Apr. 13, 1983, abandoned.

[51] Int. Cl.[3] ..... B32B 5/02

[52] U.S. Cl. ..... 428/234; 34/243 C; 139/383 A; 428/238; 428/239; 428/247; 428/257; 428/258; 428/259; 428/282

[58] Field of Search ..... 428/234, 238, 239, 247, 428/257, 258, 259, 288, 282; 34/243 F; 139/383 A

[56] References Cited

U.S. PATENT DOCUMENTS 4,461,803 7/1984 Booth et al. ..... 428/234

*Primary Examiner*—Marion E. McCamish

*Attorney, Agent, or Firm*—Anthony S. Volpe

[57] ABSTRACT

A papermakers felt having improved void volume and a method for manufacturing of the felt are disclosed. The felt as woven comprises at least three plies with one ply being comprised of removable yarns. Through removal of the removable yarns, a series of voids are created in the final felt.

22 Claims, 3 Drawing Figures

PAPERMAKERS SUPERIMPOSED FELT WITH VOIDS FORMED BY REMOVING YARNS

This is a continuation of application Ser. No. 484,575, filed Apr. 13, 1983, now abandoned.

BACKGROUND OF THE INVENTION

1. Field of the Invention

This invention relates to a fabric for use on a papermaking machine. The fabric is particularly suited to provide a felt having abrasion resistance and controlled void volume for use in that portion of a papermaking machine which is generally referred to as the wet press section. The ability to control abrasion and void volume of the felt is of particular value in the wet press section of a papermaking machine in that it directly contributes to fabric life and controlling the amount of rewetting which takes place after the fabric has passed through the press rollers in the wet press section of the papermaking machine.

BRIEF DESCRIPTION OF THE PRIOR ART

The prior art for some time has recognized the need to produce long wearing felts having predictable void volume which are able to maintain the weave structure and void volume under pressure and to withstand other compression related phenomena which can reduce the designed level of retained void volume.

One prior art in such a papermaking fabric may be seen in U.S. Pat. No. 4,119,753. This patent discloses a papermaker's felt having interwoven warp and filling yarns on its face side and bulky rib forming yarns on its machine side to define water conveying channels between the rib yarns, there is a batt surface on the face side of the fabric needled through the warp and filling yarns and into the rib forming yarns. The rib forming yarns are impregnated, after needling, with a resin which renders them essentially incompressible. The rib forming yarns are initially attached to the warp yarns of the face side fabric by light holding yarns. If the holding yarns are to be removed, they are preferably formed from fibers which will dissolve.

Another prior art attempt is seen in U.S. Pat. No. 4,187,618. This patent discloses a papermaker's felt having drainage channel yarns disposed along the bottom surface thereof secured thereto by binder yarns. The construction of this fabric is similar to that described in connection with the above identified patent.

Another prior art attempt is exemplified by U.S. Pat. No. 4,283,454. This patent discloses a papermaker's wet felt with ribbed and smooth surfaces much in the manner of the above identified patents. However, the method of making the disclosed papermaker's felt consists of independently weaving the lower and intermediate cloths and then needling the upper batt thereto in order to secure the fabric components as a unit.

U.S. Pat. No. 4,141,388 discloses a duplex base, multilayered flat woven composite fabric for a papermachine dryer.

U.S. Pat. No. 4,151,323 discloses a papermaker's belt. This patent relates to a multi-layered belt which comprises a fibrous base layer the fibers of which are resin encapsulated, and a substantially resin free fibrous surface layer in which portions of the fibers in contact the fibers of the base layer are also substantially entirely encapsulated with resin. The disclosure does not deal with the problems of producing extended fabric life and controlling stable void volumes in the fabric.

U.S. Pat. No. 4,259,394 discloses a papermaking fabric with enhanced dimensional stability. The fabric is composed of a base having a fibrous batt needled to one surface thereof, the base being formed of interwoven core wrapped yarns, comprising core yarns which are effectively heat infusible and wrapping yarns which are effectively heat fusible, the fibrous batt being either heat fusible or heat infusible, wrapping yarns of the interwoven base being heat fused to each other at their points of contact with each other on the side of the interwoven base opposite the fibrous batt.

U.K. Patent Specification No. 801,440 is of interest in that it teaches the use of thermoplastic fibers to secure a batt to a fabric. The specification notes that the thermoplastic fibers may be woven into the fabric or introduced as a surface layer of fibers not woven into the fabric but attached thereto by conventional needling operations. There is no disclosure with respect to weave structure or control of void volume.

U.K. Patent Specification No. 963,212 discloses the use of solvents to cause swelling and/or near solvent action on synthetic yarns to produce a binder. The yarns are not dissolved by the solvents and the solvent is removed from the fabric through washing. There is no teaching with respect to weave structure or void volume control.

SUMMARY OF THE INVENTION

The disclosed papermaker's wet felt is particularly adapted to control void volume and to increase fabric stability when used in the wet press section of a papermaking machine. The disclosed felt comprises two independent fabrics and a batt which are united in a single felt.

A construction for weaving the independent fabrics in a single loom and for constructing the unified felt is disclosed.

It is an object of the invention to provide a papermaker's wet felt having improved abrasion resistance controlled void volume and increased fabric stability.

DESCRIPTION OF THE PREFERRED EMBODIMENT

Referring now to the attached illustrative drawings, the invention will be described with reference thereto with like numerals indicating like elements in all figures.

In the preferred embodiment, the base fabric is woven endless. However, those skilled in the art will recognize that the fabric may be flat woven and seamed to produce what is effectively an endless belt. In order to facilitate a description of the invention, the yarn systems will be referred to in accordance with their position on the papermaking machine, namely, machine direction and cross machine direction yarns. Machine direction yarns extend in the direction of travel on the machine and cross machine direction yarns extend transverse to the direction of travel.

Figure 1:
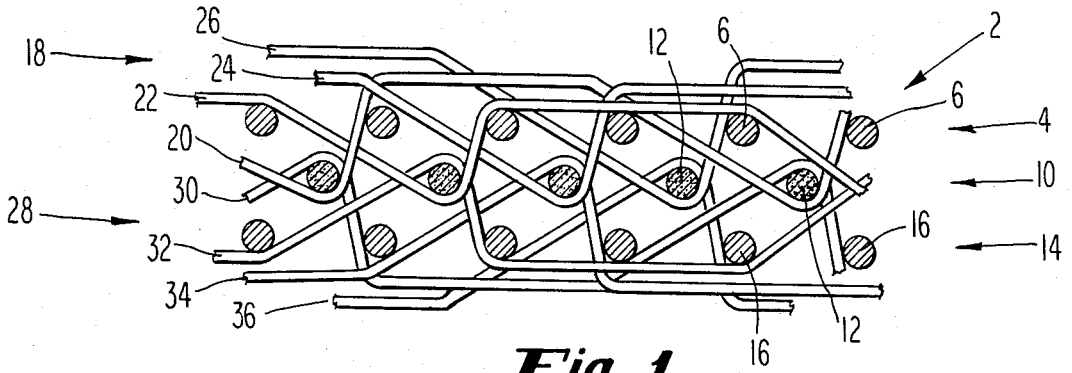
FIG. 1 is a section cut through in an illustrative base fabric.

With reference now to FIG. 1, there is shown in illustrative base fabric 2 which is woven as a double four harness sateen. The base fabric 2 is comprised of a first machine direction yarn system 4, a second machine direction yarn system 10 and a third machine direction yarn system 14 which are interwoven with a first cross machine direction yarn system 18 and a second cross machine direction yarn system 28.

First machine direction yarn system 4 is comprised of a plurality of machine direction monofilament yarns 6. A second cross machine direction yarn system 10 is comprised of a plurality of removable yarns 12. In the preferred embodiment, the removable yarns 12 are dissolving yarns, such as Solvron two-ply which is available from Hickory Throwing Company located in Hickory, N.C. The third machine direction yarn system 14 is comprised of a plurality of machine direction monofilament yarns 16. It will be apparent to those skilled in the art, that light or cabled yarns may be used in place of the monofilament yarns and the actual load bearing machine direction yarns may be varied in accordance with the end use considerations of the final felt. The yarns of cross machine direction yarn systems 18 and 28, in the preferred embodiment, are single monofilament yarns. However, once again, the yarns may be varied in accordance with the end use of the final felt.

Still with reference to FIG. 1, it will be noted that yarns 12 of the second cross machine direction yarn system 10 are positioned so as to be staggered with respect to the yarns comprising first machine direction yarn system 4 and third machine direction yarn system 14.

Cross machine direction yarn system 18 is interwoven with machine direction yarn systems 4 and 10 so as to produce a float length of at least three machine direction yarns adjacent to the plane defined by machine direction yarn system 4. Thus, yarns 20, 22, 24 and 26 extend across three adjacent machine direction yarn 6 and then extend inwardly beneath the next adjacent machine direction yarn 6 around the next available machine direction yarn 12 and outwardly to the surface. Each of the yarns 20, 22, 24 and 26 repeats on a total of four machine direction yarns 6.

Cross machine direction yarn system 28 is comprised of cross machine direction yarns 30, 32, 34 and 36. The yarns of cross machine direction yarn system 28 are interwoven with the yarns of machine direction yarn system 14 and machine direction yarn system 10 and may be generally considered as the mirror image of the interwoven yarns of cross machine direction 18. Thus, yarns 30, 32, 34 and 36 extend beneath three adjacent machine direction. Such a weave structure provides a relatively long float on the face of the structure to enhance pressing uniformity while providing a relatively long float on the opposite side for wear or abrasion resistance. As will be understood by those skilled in the art, weave construction and yarn count contribute to the void volume characteristics of the final fabric and, therefore, the construction and count should be selected in accordance with the end product application.

Figure 2:
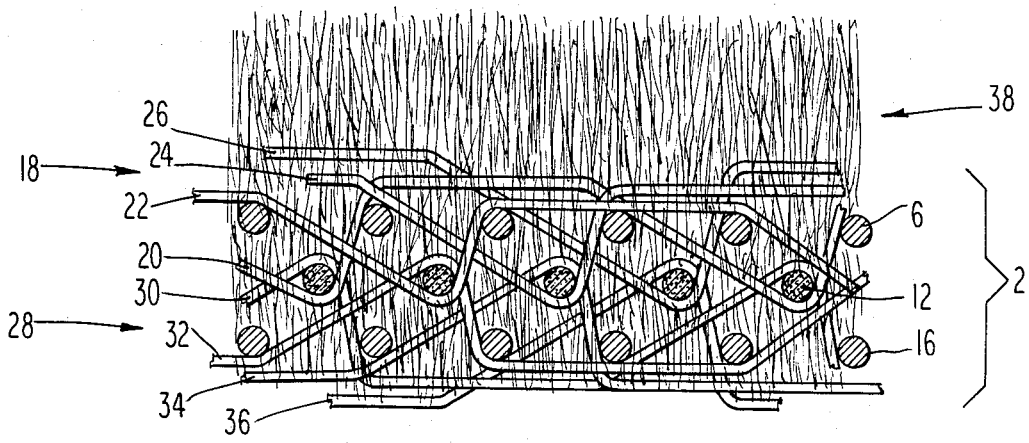
FIG. 2 is a section cut through an illustrative base fabric with a fibrous batt needled thereto.

With reference to FIG. 2, a batt 38 is needled to the base fabric of FIG. 1. Batt 38, as will be known to those skilled in the art, may be made of different materials and density according to end product application. The batt 38 is needled to the base fabric using techniques known in the art. If desired, a second batt may be needled to the fabric of FIG. 2 opposite batt 38. Thus, the fabric may be constructed with a batt on one or both faces of the fabric.

Figure 3:
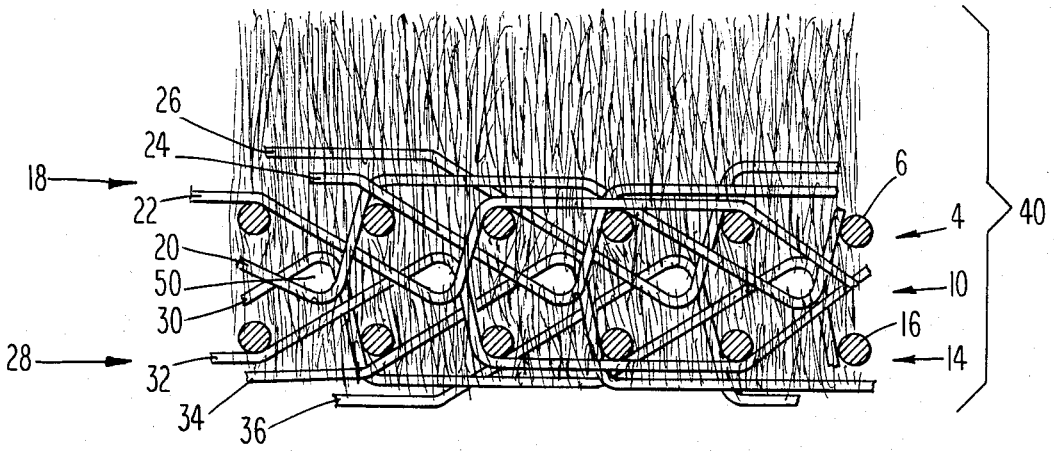
FIG. 3 is a section cut through an illustrative completed felt.

With reference to FIG. 3, it can be seen that the construction of felt 40 as illustrated, does not include the second machine direction yarns 12 which comprised second machine direction yarn system 10. As noted previously, second machine direction yarns 12 were dissolvable yarns. In the preferred embodiment, the dissolvable yarns are removed from the fabric, after the batt 38 has been needled thereto, by washing the fabric of FIG. 2 in a suitable solvent at a temperature of approximately 160° F. It will be understood that soluble yarns other than the example previously given are available from various manufacturers and that information and data with respect to dissolving the yarns is available from the respective manufacturers.

It should be noted at this point, that the technology for weaving multi-layered fabrics for felt bases was begun primarily to increase void volume under pressure. With integral multi-layered fabrics, it has been noted that weave collapse and other compression related phenomenon can cause the designed level of retained void volume to be reduced. With separate fabrics, it can be observed that one fabric cannot be pushed through the other and thereby reduce the void base area. However, manufacturing two separate fabric belts poses difficult processing problems which can result in lower fabric quality and higher rejection rates. In addition to manufacturing difficulties associated with handling separate fabrics, its is also difficult to predict the void volume characteristics of two separately manufactured fabrics which are later joined or processed.

The disclosed method for producing a felt takes advantage of both multi-layered fabric weaving technology and separate fabric design. The present method allows for two fabrics to be processed as a single unit and thereby gains the advantage of the separate fabric concept while utilizing the technology of multi-layer weaving. As a result, the fabric according to the present invention has increased abrasion resistance, void volume, improved void volume retention, ease of manufacturing and the desirable characteristics of two separate fabrics. Thus, with reference to FIG. 3, it can be seen that a first fabric will result from the interweaving of machine direction yarn system 4 and cross machine direction yarn system 18 and that a second fabric results from the interweaving of machine direction yarn system 14 and cross machine direction yarn system 18. The two separate fabrics, as seen in FIG. 3, do not have any shared or common yarn systems and are retained in the felt 40 as a result of the needling process used to incorporate the batt, 38 of FIG. 2, into the felt.

With reference to FIG. 3, it can be seen that the yarns of cross machine direction yarn system 18 are interwoven with the yarns of machine direction yarn system 4 only in the plane of machine direction yarns 4 and that the cross machine direction yarns 20, 22, 24 and 26 extend freely into a second plane which was previously identified as the plane containing removable yarns 12. Likewise, it can be seen that the yarns of cross machine direction yarn system 28 only interweave with the yarns of machine direction yarn system 14 in a single plane and that the yarns 30, 32, 34 and 36 extend freely into the second plane previously occupied by the removable yarns 12. In the preferred embodiment, the yarns of cross machine direction yarn systems 18 and 28 alternate in the intermediate plane and extend beyond each other by a distance substantially equal to the diameter of the removable yarns 12, as shown in FIG. 2. It will be recognized by those skilled in the art that the yarns of cross machine direction yarn systems 18 and 28 will be interspersed within the intermediate plane according to the weave pattern selected and that they will not necessarily be interspersed in an alternating arrangement as is shown in the illustrative embodiment. It can be seen that as a result of the weave pattern and the absence of removable yarns 12, that a series of voids 50 are formed in the intermediate plane and are defined by the freely extending yarn portion of cross machine direction yarns systems 18 and 28. The voids 50 defined by the interspersing of yarns from cross machine direction yarn systems 18 and 28 will be generally coplanar and will extend parallel to the machine direction yarn systems.

In the preferred embodiment, the diameter of removable yarns 12 is approximately equal to the diameter of the remaining machine direction yarns in yarn systems 4 and 14. However, it will be understood by those skilled in the art, that the diameter of removable yarns 12 can be varied according to the yarns available, the weaving loom and the desired voids 50.

It will be understood by those skilled in the art that as a result of the needling operation some of the needled fibers will extend into the void spaces previously occupied by machine direction yarns 12, however, the voids created by dissolving machine direction yarns 12 are maintained. In addition, through testing of laboratory samples, it has been found that felt 40 may be sheared or pulled apart by applying opposing forces to the fabrics and that the fabrics will behave independently and that the retention as a unit is primarily determined by the needling of the batt 38 thereto.

In an alternative embodiment of the invention, fusible yarns are used in place of the soluble yarns in the weaving of the base fabric 2. Thus, with reference to FIG. 1, the yarns 12 of machine direction yarn system 10 would be fusible yarns, such as fusible Wonder Thread monofilament nylon which is available from the Shakespeare Company in Columbia, S.C. The base fabric 2, in all other regards, is constructed in accordance with the description set out hereinabove. In the alternative embodiment, the batt 38 is needled to the base fabric 2 as shown in FIG. 2. The final construction of the alternative embodiment is substantially the same as that illustrated in FIG. 3.

With the use of fusible or meltable yarns in the alternative embodiment, the felt after the needling of batt 38 thereto is subjected to the yarn manufacturers suggested temperature and pressure in order to melt or remove the fusible yarns 12. As a result of the melting operation, the fusible yarns will be dispersed throughout the felt and voids in the felt structure will be created as is shown in FIG. 3. It will be understood by those skilled in the art that the use of fusible or meltable yarns will produce some additional fabric retention, however, it should be emphasized at this point that the voids created in the machine direction yarn system 10 are substantially as depicted in FIG. 3. Furthermore, it has been observed that the felt will, as previously described, behave as two separate fabrics. However, depending upon the amount of needling undertaken to secure the batt 38 to the fabric 2, an increase resistance to shear may be observed as a result of the meltable yarn. In some applications, the use of meltable yarns may be preferred because of the improved batt retention which results.

It will be understood by those skilled in the art that the embodiments illustrated and discussed and the terms and expressions used are by way of illustration and not by way of limitation and that it will be recognized by those skilled in the art that the invention may be practiced in other embodiments without departing from the spirit and scope of the invention.

We claim:

1. A papermaker's felt comprising at least:

a first yarn system of machine direction yarns defining a first plane;

a second yarn system of cross machine direction yarns interwoven with said first yarn system in said first plane and extending freely beyond said first plane into a second plane adjacent to said first plane;

a third yarn system of machine direction yarns defining a third plane adjacent to said second plane;

a fourth yarn system of cross machine direction yarns interwoven with said third yarn system in said third plane and extending freely above said third plane and into said second plane and cooperating with said second yarn system to define a plurality of void in said felt; and a batt needled adjacent to said first plane and having portions thereof extending into said first, second and third planes and retaining said planes relative to each other.

2. The felt of claim 1 wherein all of said yarns systems are comprised of monofilament yarns.

3. The felt of claim 1 wherein the yarns of said second and fourth system are interspersed within said second plane, and extend beyond each other by a predetermined distance and define a series of voids within said belt.

4. The felt of claim 3 wherein said predetermined distance is no greater than the diameter of the largest machine direction yarn.

5. The felt of claim 3 wherein said series of voids are coplanar.

6. The felt of claim 3 wherein said voids are generally parallel to each other and to said machine diretion yarns.

7. An improved multi-ply fabric for use as a papermaker's fabric, said fabric being of the type having controlled void volume through out and comprising at least a first yarn system of machine direction yarns, an intermediate yarn system of machine direction yarns, a third yarn system of machine direction yarns, a fourth yarn system of cross machine direction yarns interwoven with said first and intermediate machine direction yarn system and a fifth yarn system of cross machine direction yarns interwoven with said intermediate and third machine direction yarns systems, the improvement characterized by:

said intermediate yarn system being comprised of removable yarns.

8. A method for making a papermaker's wet felt structure having improved void volume said method comprising at least the steps of:

providing a first system of machine direction yarns;

providing a second system of machine direction yarns, said second system of machine direction yarns comprised of removable yarns;

providing a third system of machine direction yarns;

providing a fourth yarn system of cross machine direction yarns interwoven with said first and second yarn systems of machine direction yarns;

providing a fifth yarn system of cross machine direction yarns interwoven with said second and third yarn systems of machine direction yarns;

needling a batt adjacent to at least one of said machine direction yarn systems, said needled portion of said batt having at least a portion thereof which extends into said at least said second and third yarn systems and retains said yarn systems relative to each other; and removing said removable yarns of the second yarn system of machine direction yarns from said structure to define a plurality of void in said structure.

9. The method of claim 8 wherein said removable yarns are soluble yarns.

10. The method of claim 9 further comprising the steps of needling a second batt opposite said batt and adjacent to another of said machine direction yarn systems.

11. The method of claim 9 wherein said soluble yarn have a yarn diameter no greater than the diameter of the yarns in said first and third systems of machine direction yarns.

12. The method of claim 8 wherein said removable yarns are comprised of meltable yarns.

13. The method of claim 12 further comprising the steps of needling a second batt opposite said batt and adjacent to another of said machine direction yarn systems.

14. The method of claim 12 wherein said meltable yarns have a yarn diameter no greater than the diameter of the yarns in said first and third systems of machine direction yarns.

15. The method of claim 8 further comprising the steps of needling a second batt opposite said batt and adjacent to another of said machine direction yarn systems.

16. A method for making a papermaker's wet felt structure having improved void volume said method comprising at least the steps of:

providing a top layer of machine direction yarns;

providing an intermediate layer of machine direction yarns said intermediate layer comprised of removable yarns;

providing a bottom layer of machine direction yarns;

providing a system of cross-machine direction yarns interwoven with said top, middle and bottom machine direction layers, each said cross-machine direction yarns woven in repeat pattern having interlacings with machine direction yarns in at least two of said machine direction layers;

providing selected yarns among said cross-machine direction yarns interwoven with said intermediate layer and with said top layer with floats which extend over at least three top layer yarns so that said selected cross-machine direction yarns predominate the surface which they define with said top layer;

providing selected yarns among said cross-machine direction yarns interwoven with said intermediate layer and with said bottom layer with floats which extend under at least three machine direction yarns so that said selected cross-machine direction yarns predominate the surface which they define with said bottom layer;

providing a needling batt adjacent to at least one of said machine direction yarn systems, said needled portion of said batt having at least a portion thereof which extends into said at least said second and third yarn systems and retains said yarn systems relative to each other; and removing said removable yarns of the second yarn system of machine direction yarns from said structure to define a plurality of void in said structure.

17. The method of claim 16 wherein said intermediate layer of machine direction yarn is comprised of soluble yarns.

18. The fabric of claim 16 wherein said intermediate layer system of machine direction yarns is comprised of meltable yarns.

19. A method for making a papermaker's wet felt comprising at least the steps of:

providing a first system of machine direction yarns;

providing a second system of machine direction yarns, said second system of machine direction yarns comprised of soluble yarns;

providing a third system of machine direction yarns;

providing a fourth yarn system of cross machine direction yarns interwoven with said first and second yarn systems of machine direction yarns;

providing a fifth yarn system of cross machine direction yarns interwoven with said second and third yarn systems of machine direction yarns;

needling a batt adjacent to at least one of said machine direction yarn systems to retain at least said first and third systems relative to each other; and dissolving said soluble yarns of the second yarn system of machine direction yarns to define a plurality of voids.

20. The method of claim 19 further comprising the steps of needling a second batt opposite said batt and adjacent to another of said machine direction yarn systems.

21. The method of claim 19 wherein said soluble yarn have a yarn diameter no greater than the diameter of the yarns in said first and third systems of machine direction yarns.

22. The method of claim 21 further comprising the steps of needling a second batt opposite said batt and adjacent to another of said machine direction yarn systems.

* * * * *